US011084557B2

(12) United States Patent
Oesmann et al.

(10) Patent No.: US 11,084,557 B2
(45) Date of Patent: Aug. 10, 2021

(54) CLOSING DEVICE

(71) Applicants: THYSSENKRUPP MARINE SYSTEMS GMBH, Kiel (DE); thyssenkrupp AG, Essen (DE)

(72) Inventors: Hans Oesmann, Hamburg (DE); Marko Schulz, Drage (DE); Sebastian Halfmann, Norderstedt (DE)

(73) Assignees: THYSSENKRUPP MARINE SYSTEMS GMBH, Kiel (DE); THYSSENKRUPP AG, Essen (DE)

( * ) Notice: Subject to any disclaimer, the term of this patent is extended or adjusted under 35 U.S.C. 154(b) by 444 days.

(21) Appl. No.: 16/300,616

(22) PCT Filed: Jun. 14, 2017

(86) PCT No.: PCT/EP2017/064475
§ 371 (c)(1),
(2) Date: Nov. 12, 2018

(87) PCT Pub. No.: WO2017/216200
PCT Pub. Date: Dec. 21, 2017

(65) Prior Publication Data

US 2020/0307743 A1 Oct. 1, 2020

(30) Foreign Application Priority Data

Jun. 14, 2016 (DE) ..... 10 2016 210 531.0

(51) Int. Cl.
*B63B 19/18* (2006.01)
*B63B 19/19* (2006.01)
*B63B 19/08* (2006.01)

(52) U.S. Cl.
CPC ..... *B63B 19/19* (2013.01); *B63B 19/08* (2013.01); *E05Y 2900/514* (2013.01)

(58) Field of Classification Search
CPC ..... B63B 2019/083; B63B 2019/086; B63B 19/12; B63B 19/14; B63B 2019/145; B63B 19/16; B63B 19/18; B63B 19/19; B63B 19/00; B63B 2019/0007; B63B 2019/0053; B63B 2019/0092; B63B 19/04; B63B 19/08
(Continued)

(56) References Cited

U.S. PATENT DOCUMENTS 2,753,828 A 7/1956 Mege
3,217,785 A * 11/1965 Hamilton ..... B63B 19/203 160/188
3,557,738 A * 1/1971 Hanssen ..... B63B 19/203 114/202

FOREIGN PATENT DOCUMENTS

DE 102 56 984 B 8/2005
DE 10 2004 035 640 A 2/2006
(Continued)

OTHER PUBLICATIONS

English Translation of International Search Report issued in PCT/EP2017/064475, dated Aug. 17, 2017.

*Primary Examiner* — Daniel V Venne
(74) *Attorney, Agent, or Firm* — thyssenkrupp North America, LLC

(57) ABSTRACT

A closing device configured to close an outer shell opening of a surface ship, including several substantially vertically mounted shutter lamellas and a drive device by means of which the shutter lamellas can be actuated such that they move between a closed position and an open position.

9 Claims, 8 Drawing Sheets

(58) Field of Classification Search
USPC ..... 114/116, 117, 118, 119, 120, 173, 176,
114/177, 178, 201 R, 202, 203, 361, 382
See application file for complete search history.

(56) References Cited

FOREIGN PATENT DOCUMENTS

| | | | |
|---|---|---|---|
| FR | 1248636 | A | 12/1960 |
| FR | 2 540 175 | A | 8/1984 |
| FR | 2 925 567 | A | 6/2009 |
| JP | 2004 026 091 | A | 1/2004 |

* cited by examiner b)

a)

CLOSING DEVICE

CROSS REFERENCE TO RELATED APPLICATIONS

This application is a U.S. National Stage Entry of International Patent Application Serial Number PCT/EP2017/064475, filed Jun. 14, 2017, which claims priority to German Patent Application No. DE 10 2016 210 531.0, filed Jun. 14, 2016, the entire contents of both of which are incorporated herein by reference.

FIELD

The present disclosure generally relates to methods for coating surfaces of metal strip, metal strip-coating devices, computer products for use in connection with metal strip devices, and methods of employing thermal imaging cameras.

BACKGROUND

Closing devices are normally used in military surface ships in order to close spaces arranged inside the outer shell of the ship, and open these towards the outside when necessary. These spaces normally serve as stowage compartments for dinghies which can be launched onto the water from the compartments when the closing device is opened, for which purpose for example a lifting device may be provided.

The closing device must withstand the same loads from water pressure and shock as the outer shell of the ship, and must therefore be designed correspondingly to the outer shell with regard to strength.

JP 2004 026 091 A describes a cover for a helicopter hangar of a marine vessel, wherein the cover is formed from vertical shutter lamellas and is designed for a small signature. Furthermore, DE 102 56 984 B4 describes a cover device for a recess in an outer shell of a ship, wherein the recess is part of a launcher for firing mortars and/or rocket-like munitions. This cover device is also designed for a good signature. DE 10 2004 035 640 A1 discloses a closure for an access opening to a cabin of a yacht with horizontally arranged shutter lamellas. This known prior art however pays no attention to the structural design of the closure or cover with regard to the effect of wave impacts or shock.

Thus a need exists for a closing device with regard to resistance to the effects of wave impact or shock.

DETAILED DESCRIPTION

Figure 1:
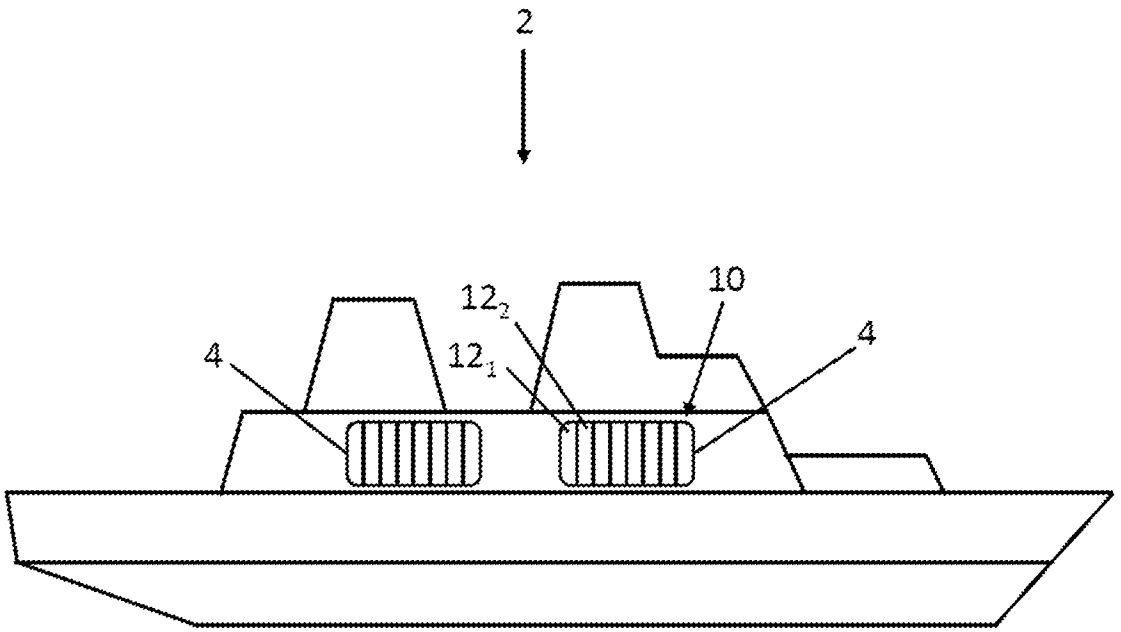
FIG. 1 is a side view of a surface ship with two outer shell openings and closing devices covering these.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to a closing device for closing an outer shell opening of a surface ship, comprising several substantially vertically mounted shutter lamellas and a drive device by means of which the shutter lamellas can be actuated such that they move between a closed position and an open position.

In some examples, a closing device for closing an outer shell opening of a surface ship, comprising several substantially vertically mounted shutter lamellas and a drive device by means of which the shutter lamellas can be actuated such that they move between a closed position and an open position, and wherein the shutter lamellas in an upper and a lower end region are held relative to each other via sliding elements in an upper and a lower guide rail of the closing device, such that on movement from the closed position to the open position, the shutter lamellas fold alternately against each other to assume the open position.

According to the invention, it is now provided that the forces occurring as a result of wave impact or shock are conducted via the sliding elements into the upper and lower guide rails and from there into the ship's structure. Therefore there is no need for the shutter lamellas to be guided in the guide rails via rollers.

An advantageous embodiment of the invention provides that an even number of shutter lamellas is provided, which can be moved in equal parts to opposite sides of the outer shell opening into the open position. In this way, firstly the conditions are created for a simple structure of the drive device, since the loading can be applied symmetrically to both parts of the shutter lamellas. Secondly, in this way, the shutter lamellas can be stowed evenly distributed on both sides of the outer shell opening in the open position.

An advantageous embodiment of the invention provides that mutually facing end sides of the sliding elements of adjacent shutter lamellas stand in an active relationship to each other via a pressure-transmission region, such that a longitudinal force imposed on the shutter lamellas in the movement direction for assuming the open position generates a transverse force component on the pressure-transmission region. In this way, advantageously it is achieved that the kinematics introduced for folding the shutter elements when moving into the open position are controlled solely by the design of the sliding elements, in particular their end faces, and no additional moving and/or actuated components need be provided. In particular, it may be provided that the pressure-transmission region of the end faces of the sliding elements is formed as a rounded contour so that adjacent sliding elements can roll on each other when assuming the open position. This guarantees a low-friction relative movement between the sliding elements. Furthermore, the shape of the contour with regard to curvature may serve to deliberately influence or change the behavior of the shutter lamellas on folding.

An advantageous embodiment of the invention provides that the sliding elements of adjacent shutter lamellas are connected together via respective connecting members. In this way, in particular a force transmission between the shutter lamellas on moving from the open position to the closed position is guaranteed. Furthermore, the connecting members perform a guidance function between the shutter lamellas on moving from the closed position to the open position.

An advantageous embodiment of the invention provides that the drive device actuates at least one of the shutter lamellas to move between the closed position and the open position, and indirectly actuates the other shutter lamellas via the at least one shutter lamella. This arrangement guarantees that the shutter lamellas which are connected only indirectly to the drive device can fold up into the open position independently of the drive device.

An advantageous embodiment of the invention provides that the drive device comprises at least one roller chain via which the at least one shutter lamella is actuated to move between the closed position and the open position. A roller chain is a robust drive means which is simple to handle.

An advantageous embodiment of the invention provides that the upper and lower guide rails comprise slide surfaces made of plastic for guiding the sliding elements in a lateral direction and a vertical direction. The plastic slide surfaces allow both low-friction sliding of the shutter lamellas and transmission of the loads from wave impact and in the event of shock to the ship's structure.

An advantageous embodiment of the invention provides that the shutter lamellas are made from a carbon-fiber reinforced plastic (CRP), glass-fiber reinforced plastic (GRP), steel or aluminum material. In this way, the shutter lamellas are able to withstand the water pressure.

An advantageous embodiment of the invention provides that the guide rails have an inner and an outer side guide stop in the movement direction of the shutter lamellas relative to the outer shell opening. This guarantees guidance of the shutter lamellas in the guide rails on both sides.

An advantageous embodiment of the invention provides that the inner side guide stop extends with a shorter path in the direction of the closed position of the shutter lamellas than the outer side guide stop. This guarantees that at least some of the shutter lamellas can be released from the guide rails in the direction of the inside of the ship so that they can be brought into the folded open position.

An advantageous embodiment of the invention provides that the guide rails each have a guide groove running in the movement direction. The guide groove guarantees that the shutter lamellas continue to be guided by the guide rails although they are in a movement position in which they have already been released from the guide rails in the direction of the inside of the ship.

An advantageous embodiment of the invention provides that the sliding elements have a guide bolt via which the sliding elements are held in the guide grooves for guidance in the movement direction. The guide bolts guarantee that the shutter lamellas can pivot in controlled fashion relative to the guide rails as soon as the shutter lamellas are in a movement position in which they have already been released from the guide rails in the direction of the inside of the ship.

An advantageous embodiment of the invention provides that the guide bolt is arranged in the region of one of the end faces of the sliding element, wherein adjacent sliding elements are arranged relative to each other such that the end faces, in the region of which the guide bolts are arranged, or the corresponding opposite end faces, in the region of which no guide bolts are arranged, lie opposite each other. This guarantees that two mutually opposing end faces of the sliding elements are alternately guided or not guided in the guide groove. This achieves the alternating folding of the shutter lamellas against each other while reaching the open position, since the shutter lamellas can pivot away in the direction of the inside of the ship in the region in which the end faces of the sliding elements are not guided in the guide grooves by means of guide bolts, as soon the sliding elements have been released from the guide rails in the direction of the inside of the ship.

An advantageous embodiment of the invention provides a contact pressure device by means of which the two outer shutter lamellas in a closed position can be pressed against an outer stop towards the outside of the ship.

FIG. 1 shows a surface ship 2 in the form of a marine ship. Above a water surface (not designated further), the surface ship 2 has two outer shell openings 4, the number of which in the present case should be regarded as exemplary. The outer shell openings 4 are each covered by a closing device 10, wherein the closing device 10 can be moved between a closed position (shown here) and an open position. For this, the closing device 10 has several movable shutter lamellas 12 which are oriented substantially vertically. In the present case, purely as an example, a closing device 10 is fitted with eight shutter lamellas 12, wherein any number deviating from this may be provided. However, it is preferred that the number of shutter lamellas 12 is even. Furthermore, it is preferred that the shutter lamellas 12 can be moved in equal parts to opposite sides of the outer shell opening 4 into the open position, i.e. starting from the closed position, they open the outer shell opening 4 centrally and move into the open position at the sides of the outer shell opening 4.

Figure 2:
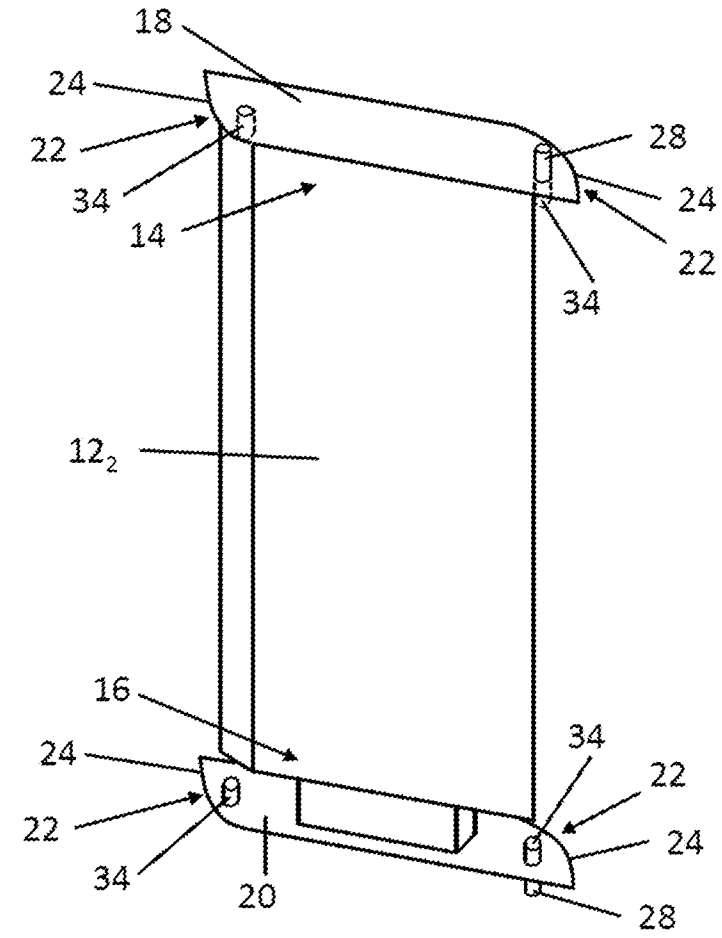
FIG. 2*a* is a perspective view of an embodiment of a shutter lamella.
FIG. 2*b* is another perspective view of an embodiment of a shutter lamella.
Figure 2:
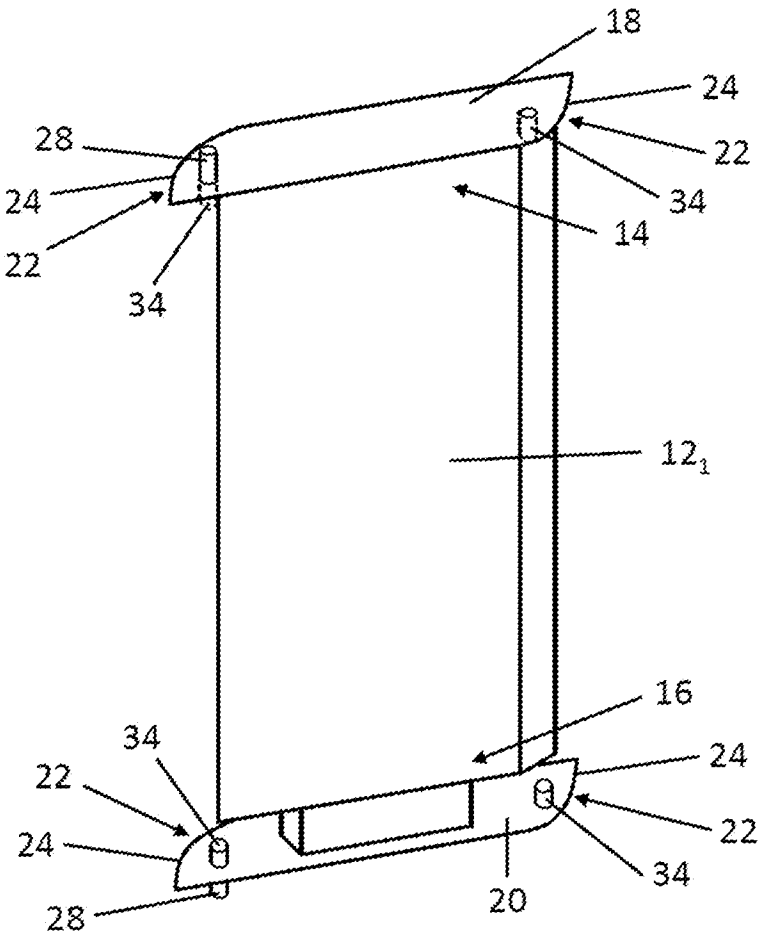

FIG. 2*a*) shows in perspective view a possible embodiment of a shutter lamella $\mathbf{12}_1$. FIG. 2*b*) shows a shutter lamella $\mathbf{12}_2$ designed symmetrically thereto. The shutter lamellas $\mathbf{12}_1$, $\mathbf{12}_2$ are described jointly below. The shutter lamella 12 has a sliding element 18 and 20 in each of an upper end region 14 and a lower end region 16. The terms "upper" and "lower" in the present description refer to the normally prevailing position of the surface ship, in which this lies horizontally on a water surface. At their end faces 22, the sliding elements 18, 12 have pressure-transmission regions 24, via which adjacent shutter lamellas 12 can come into active connection, as will be described below. Furthermore, the sliding elements 18, 20 each have a guide bolt 28 oriented upward or downward respectively towards one side, and a connecting bolt 34 oriented inward towards the other side, the function of which will also be described below.

Figure 3:
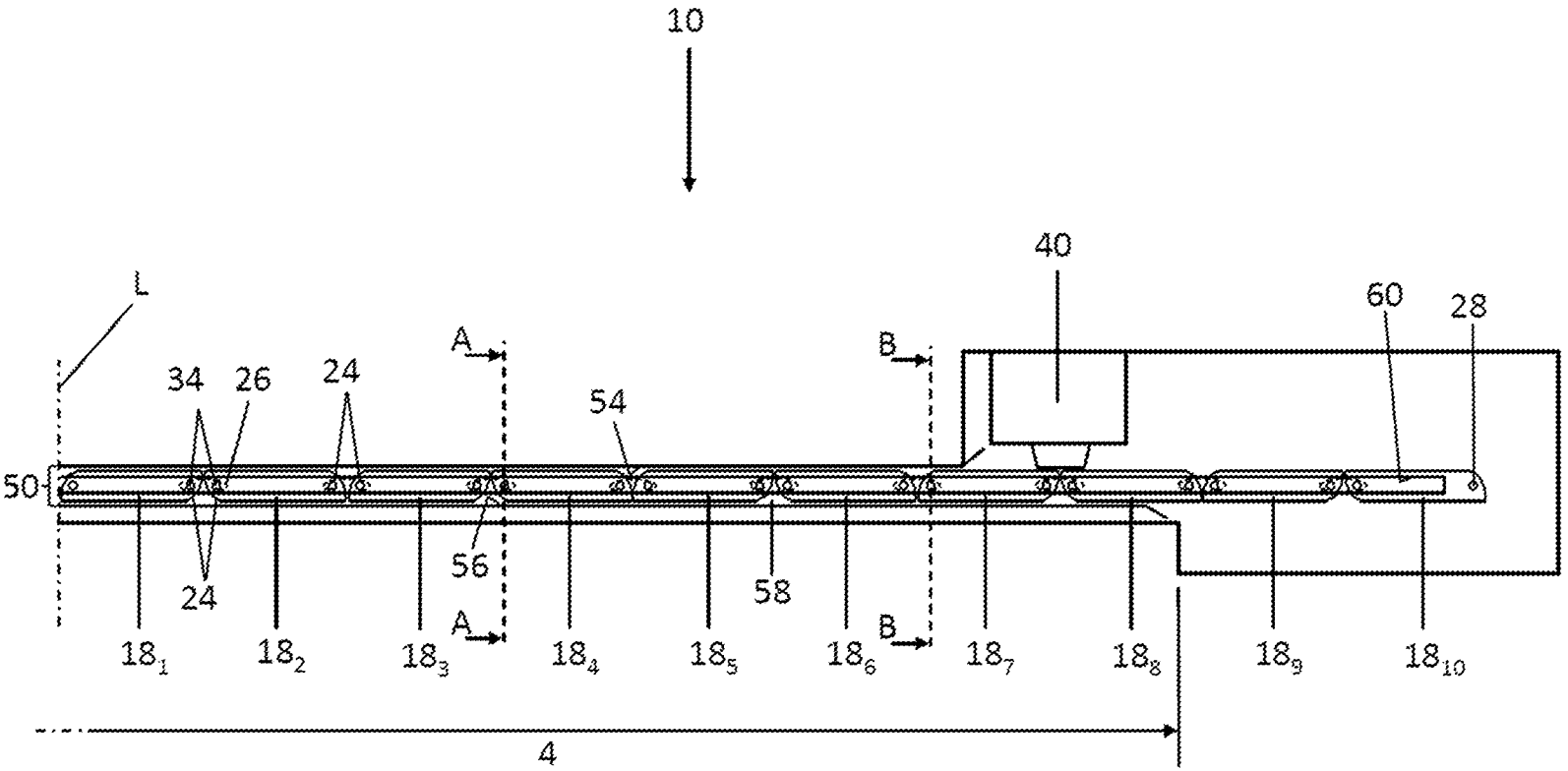
FIG. 3 is a top view of a closing device.

FIG. 3 shows a top view of the closing device 10 according to the invention, of which however, for reasons of clarity, only one half is shown and in which the second half adjoining the dotted line L has been omitted. The top view is selected such that the upper sliding elements 18 lie in the drawing plane. Furthermore, the interior of the ship is in the upper image half, and the exterior of the ship accordingly in the lower image half. Also, only half of the outer shell opening 4 is shown. The line L is not necessarily a line of symmetry, since it is preferably provided that a drive device is arranged in the region of one of the halves of the closing device 10, as will be explained below. The closing device 10 is shown in the closed position. Initially, ten sliding elements $\mathbf{18}_1$ are $\mathbf{18}_{10}$ are shown, so the corresponding shutter lamellas 12 are oriented into the drawing plane. The sliding elements $\mathbf{18}_1$ to $\mathbf{18}_{10}$ are arranged in pairs relative to each other with regard to their pressure-transmission regions 24, such that they run symmetrically to each other relative to a center line between the sliding elements 18. The arrangement means that over the course of the sliding elements 18, adjacent pressure-transmission regions 24 have a contour which opens alternately towards the outside of the ship and towards the inside of the ship.

Adjacent sliding elements 18 are connected together by means of connecting members 26 over the connecting bolts 34. Here each connecting member 26 is pivotable about a vertical axis relative to the respective connecting bolt 34. Thus adjacent sliding elements 18 are connected together via the connecting members 26 in the manner of chain links. The connecting members 26 are arranged on the inside of the sliding elements 18 relative to the shutter lamellas 12.

Figure 8:
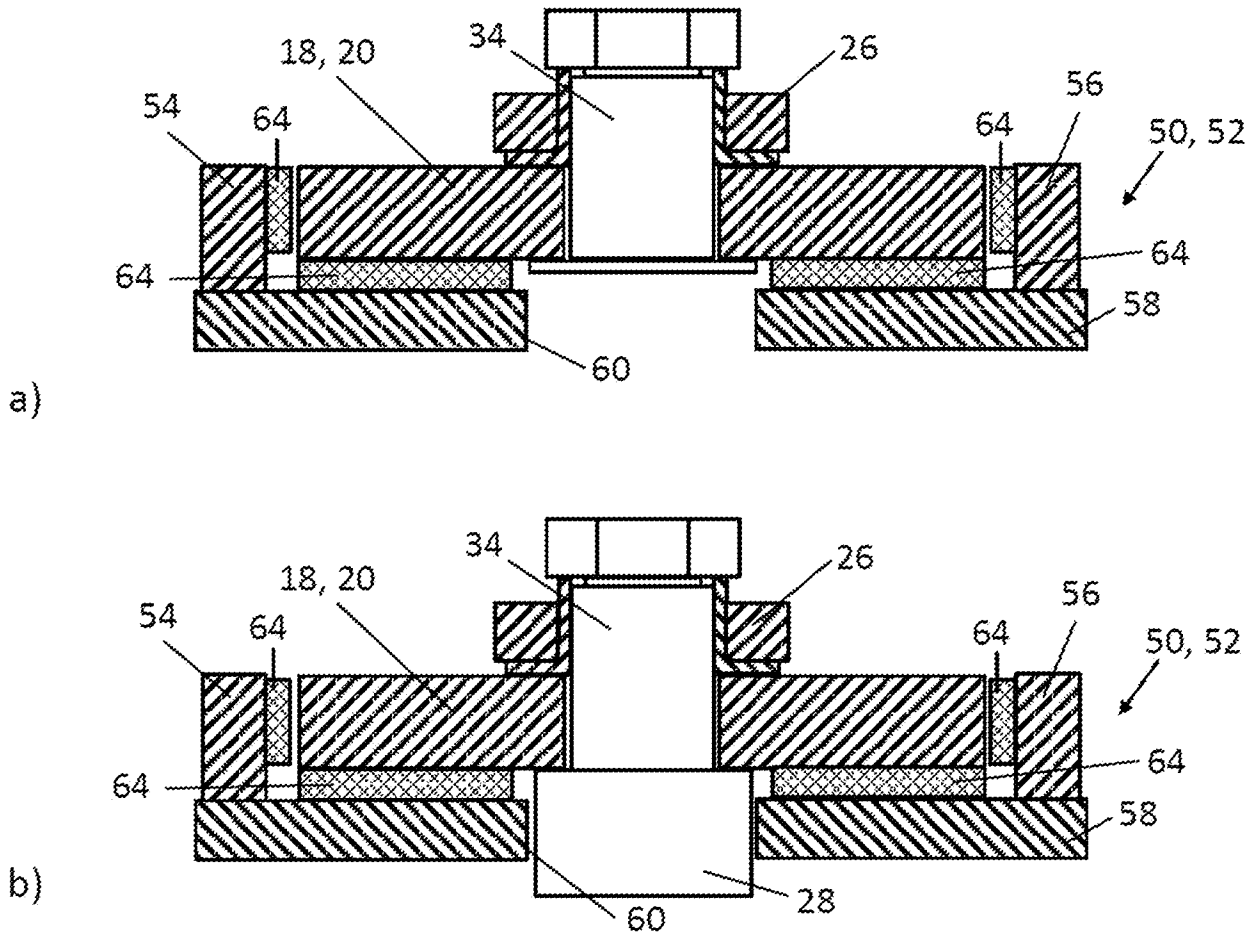
FIG. 8*a* is a detail view of a sliding element guided in a guide rail of the closing device.
FIG. 8*b* is a detail view of a sliding element guided in a guide rail of the closing device.

Furthermore, the closing device 10 comprises guide rails 50 and 52, of which FIG. 3 shows only the upper guide rail 50. The upper guide rail 50 and the lower guide rail 52 (shown in FIG. 6) are designed correspondingly to each other. The closing device 10 or the shutter lamellas 12 of the closing device 10 can be guided via the guide rails 50, 52 from the closed position to the open position and vice versa. The guide rail 50 is configured substantially U-shaped in cross-section, as shown in FIGS. 8*a*) and 8*b*). The guide rail 50 comprises an inner guide stop 54, an outer guide stop 56 and a middle guide stop 58, by means of which the sliding elements 18 are guided in the lateral and vertical directions. Furthermore, the middle guide stop 58 has a guide groove 60 in which the guide bolts 28 of the sliding elements 18, 20 engage in order to be guided. For reasons of clarity, the guide bolts 28 are not shown in FIG. 3, so reference is made to FIGS. 2*a*) and 2*b*). The sliding elements 18, 20 of the first shutter lamella $\mathbf{12}_1$ accordingly have on the left side guide bolts 28 protruding into the guide groove 60, whereas the right side of the sliding elements 18, 20 of the first shutter lamella $\mathbf{12}_1$ has no guide bolts and is not guided by the guide groove 60. The second shutter lamella $\mathbf{12}_2$ and its sliding elements 18, 20 are designed symmetrically to the first shutter lamella $\mathbf{12}_1$, i.e. the sliding elements 18, 20 of the second shutter lamella $\mathbf{12}_2$ have no guide bolts on the left side and are not guided by the guide groove 60, while the right side of the sliding elements 18, 20 has guide bolts 28 protruding into the guide groove 60. These differences are shown more clearly in the detail views of FIGS. 8*a*) and 8*b*). This alternating arrangement of the shutter lamellas 12, their sliding elements 18, 20 and the guide bolts 28 on the sliding elements 18, 20, continues in the further shutter lamellas $\mathbf{12}_3$ to $\mathbf{12}_{10}$, wherein however the guide bolt 28 of the shutter lamella $\mathbf{12}_{10}$ is no longer guided inside the guide groove 60 but held merely rotatably in the guide rail 50 so as to form a fixed rotation point for the shutter lamella $\mathbf{12}_{10}$.

Viewed from the line L, the inner guide stop 54 of the guide rail 50 has a shorter length than the outer guide stop 56 of the guide rail 50. In the region of this length difference, a contact pressure device 40 is arranged in the inside of the ship, by means of which the two shutter lamellas $\mathbf{18}_7$ and $\mathbf{18}_8$ can be pressed against the outer guide stop 56 towards the outside of the ship in the closed position.

Figure 4:
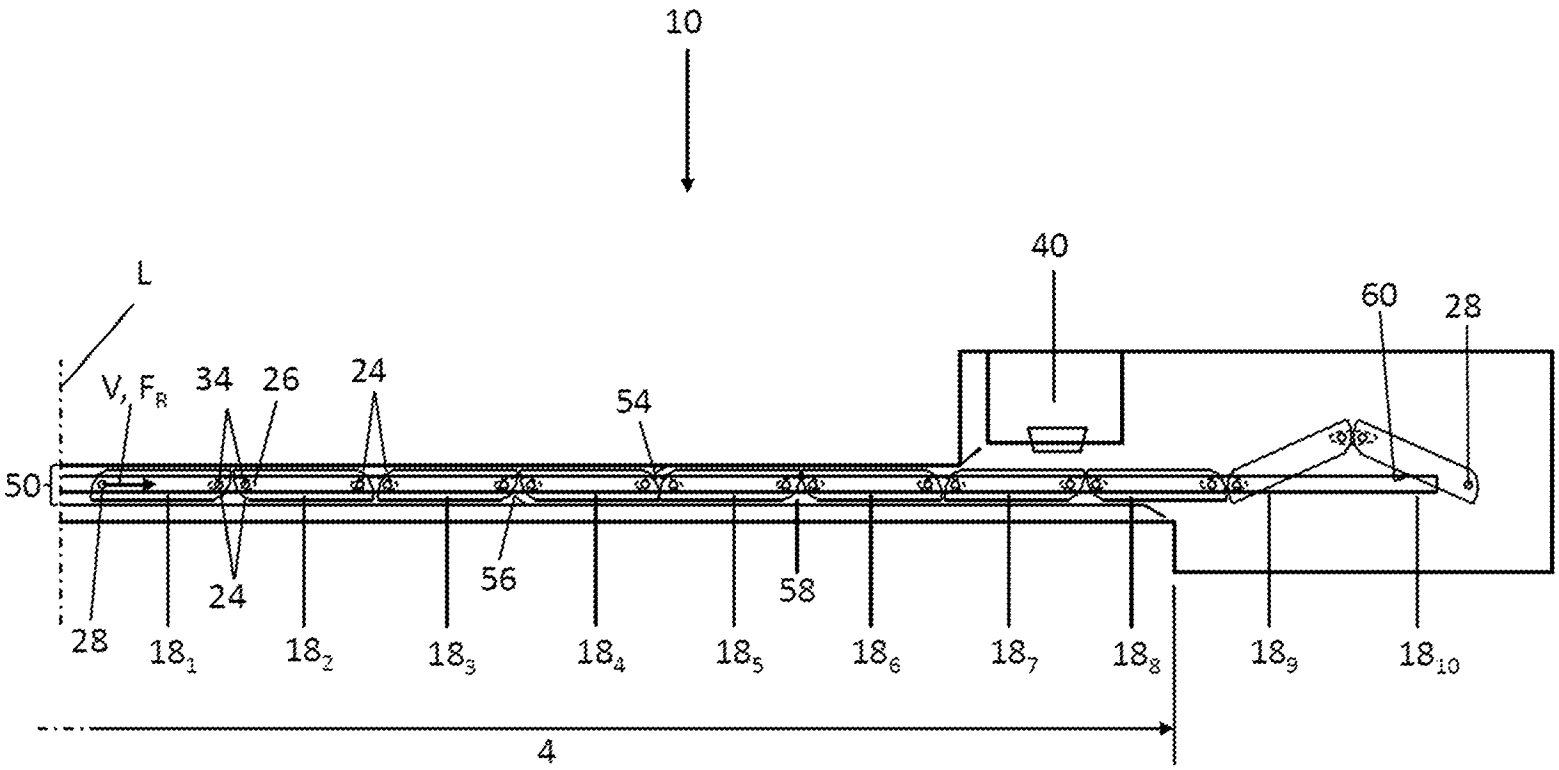
FIG. 4 is a further top view of a closing device.

FIG. 4 shows the closing device 10 in a position in which the shutter lamellas 12 have been moved by a certain amount from the closed position in the direction of the open position. The contact pressure device 40 is here in a retracted position in which it is clear of the shutter lamellas $\mathbf{12}_7$ and $\mathbf{12}_8$. The movement direction V is indicated with an arrow which has its contact point in the guide bolt 28 of the sliding element $\mathbf{18}_1$ of the first shutter lamella $\mathbf{12}_1$. Furthermore, this arrow symbolizes also a longitudinal force $F_V$ acting in the movement direction V, which is applied by the drive device 30 (to be described) on the sliding elements 18, 20 of the first shutter lamella $\mathbf{12}_1$ in order to move the shutter lamellas 12 from the closed position to the open position. In particular, according to the invention it is provided that this longitudinal force is applied directly onto the sliding elements 18, 20 of the first shutter lamella $\mathbf{12}_1$ and from there transmitted successively and indirectly to the following shutter lamellas $\mathbf{12}_2$ to $\mathbf{12}_{10}$.

Figure 5:
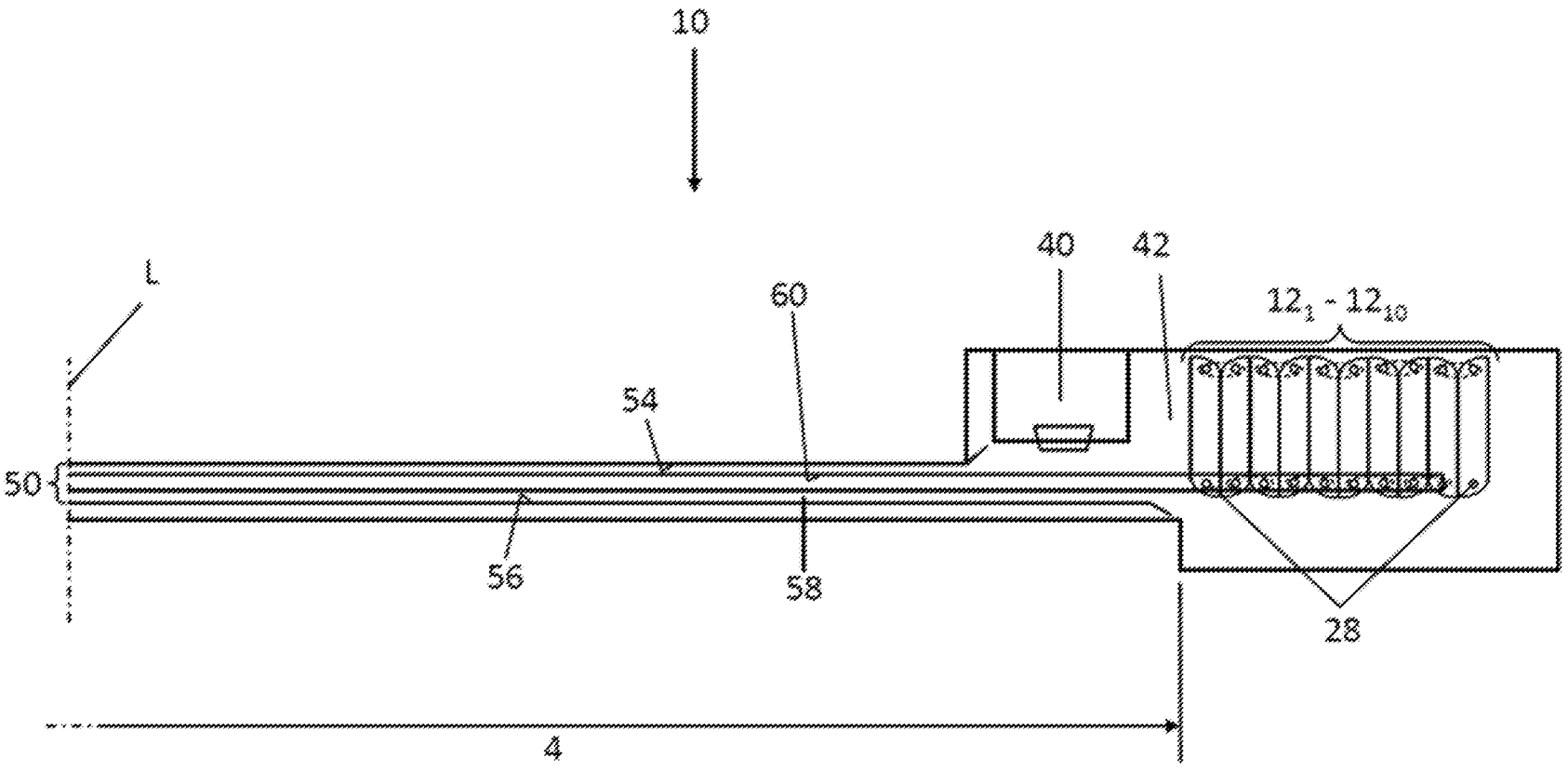
FIG. 5 is a further top view of a closing device.

FIG. 5 shows the closing device 10 or the shutter lamellas $\mathbf{12}_1$ to $\mathbf{12}_{10}$ in the fully open position. In the open position, the shutter lamellas $\mathbf{12}_1$ to $\mathbf{12}_{10}$ are folded alternately against each other in order to be arranged compactly in a stowage area 42. Folded alternately against each other means that in pairs, firstly the outward-facing surfaces of the shutter lamellas 12 are oriented against each other, and secondly the inward-facing surfaces of the shutter lamellas 12 are oriented against each other. Also, with reference to the depiction in FIG. 5, it should be stated that only one half the closing device 10 is shown, as symbolized by the line L and already described above.

Figure 6:
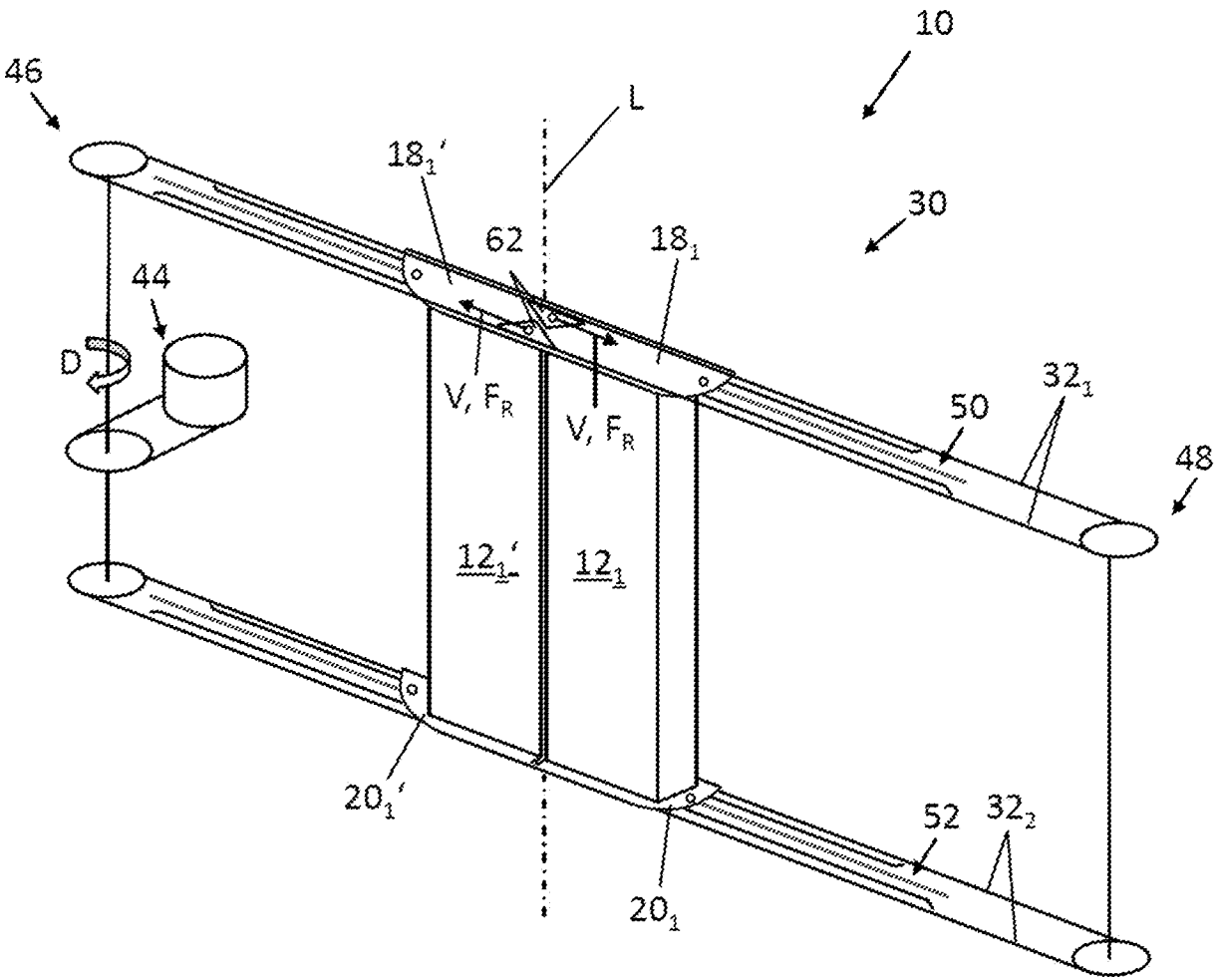
FIG. 6 is a perspective view of a closing device.

FIG. 6 shows the closing device 10 in a diagrammatic depiction and not to scale. It shows the drive device 30, the upper and lower guide rails 50, 52, and two shutter lamellas $\mathbf{12}_1$ and $\mathbf{12}_1$'. The two shutter lamellas $\mathbf{12}_1$, $\mathbf{12}_1$' are the respective first shutter lamella 12 of the two halves of the closing device 10 as described above. The two shutter lamellas $\mathbf{12}_1$, $\mathbf{12}_1$' can be moved by the drive device 30 to opposite sides into the open position. The drive device 30 comprises an upper roller chain $\mathbf{32}_1$ and a lower roller chain $\mathbf{32}_2$, drive means 44, for example in the form of an electric motor or a pneumatic motor for driving the roller chains $\mathbf{32}_1$, $\mathbf{32}_2$, and two deflectors 46, 48 on opposite sides of the closing device 10 and over which the roller chains $\mathbf{32}_1$, $\mathbf{32}_2$ are guided. The deflector 46 is driven by the drive means 44 and the other deflector 48 is designed to be passive. The two roller chains $\mathbf{32}_1$, $\mathbf{32}_2$ are driven via the deflector 46. The two roller chains $\mathbf{32}_1$, $\mathbf{32}_2$ are configured as endless chains and each connected for drive purposes to the two shutter lamellas $\mathbf{12}_1$ and $\mathbf{12}_1$'. Here, the upper roller chain $\mathbf{32}_1$ is connected to the upper sliding elements $\mathbf{18}_1$ and $\mathbf{18}_1$', and the lower roller chain $\mathbf{32}_2$ is connected to the lower sliding elements $\mathbf{20}_1$ and $\mathbf{20}_1$' of the shutter lamellas $\mathbf{12}_1$, $\mathbf{12}_1$'. The outer strands, relative to the inside and outside of the ship respectively, of the two roller chains $\mathbf{32}_1$, $\mathbf{32}_2$ are here connected to one of the shutter lamellas $\mathbf{12}_1$, $\mathbf{12}_1$', in the present case the shutter lamella $\mathbf{12}_1$', and the inner strands of the two roller chains 42, 44 are here connected to the other of the shutter lamellas $\mathbf{12}_1$', $\mathbf{12}_1$, in the present case the shutter lamella $\mathbf{12}_1$. The roller chains 42, 44 are connected to the sliding elements 18, 20 via carrier elements 62, of which only those of the upper sliding element $\mathbf{18}_1$', $\mathbf{18}_1$ are shown. The carrier elements 62, viewed in the movement direction V, are arranged with an undercut to each other so that the two shutter lamellas $\mathbf{12}_1$, $\mathbf{12}_1$' are braced relative to each other in the closed position.

In order to move the shutter lamellas 12 from the closed position shown to the open position, the drive means 44 may be driven in the rotation direction D symbolized by the arrow. In this way, in the movement direction V, a longitudinal force $F_V$ is exerted on the roller chains $32_1$, $32_2$ so that the respective front strand of both roller chains $32_1$, $32_2$ moves the shutter lamella $12_1$' to the left, while the respective rear strand of both roller chains $32_1$, $32_2$, due to the 180° looping around the deflector 48, moves the shutter lamella $12_1$ to the right. When the drive means 44 is rotated in the opposite direction, the shutter lamellas 12 are moved accordingly into the closed position. As already described, the shutter lamellas 12 are here guided via the sliding elements 18, 20 in the upper and lower guide rails 50, 52.

Figure 7:
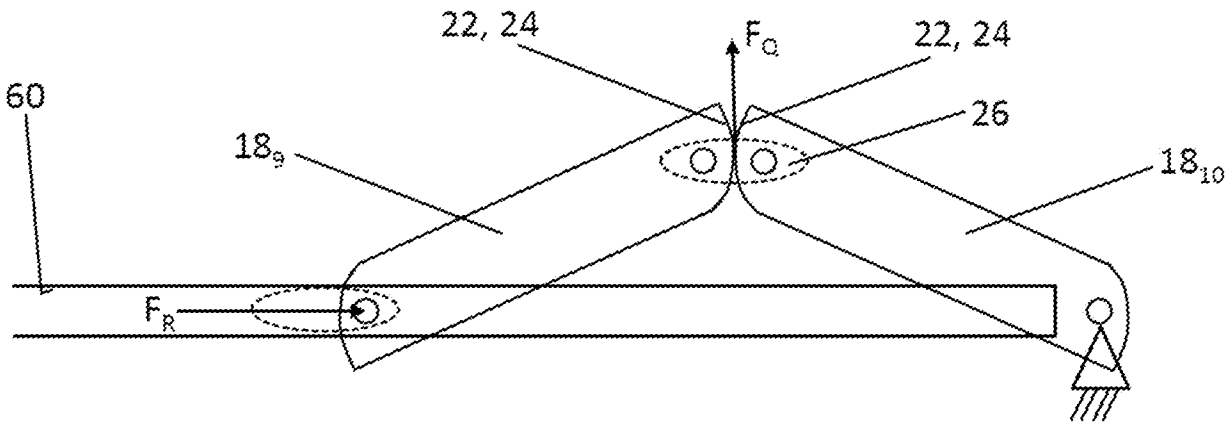
FIG. 7 is a detail view of two sliding elements of a closing device.

FIG. 7 shows in a detailed depiction the process of folding the two sliding elements $18_9$ and $18_{10}$ against each other, as has already been shown for the half of the closing device depicted in FIG. 4. The sliding element $18_{10}$ is held pivotably but immovably at one end, for example on the guide rail 50 or directly on the ship's structure. The sliding element $18_9$ is held at one end movably in the guide groove 60, and at this end is subjected to a longitudinal force $F_R$ as has been described in connection with FIG. 6. The mutually facing ends of the sliding elements $18_9$, $18_{10}$ are in contact via curved pressure-transmission regions 24, and hence in an active connection. At these ends, the sliding elements $18_9$, $18_{10}$ are not guided in the guide groove 60 but merely connected pivotably together via the connecting member 26. Due to the curved or rounded pressure-transmission regions 24 on the end faces 22 of the sliding elements $18_9$, $18_{10}$, an automatic folding of the shutter lamellas 12 occurs on assuming the open position. This folding movement is controlled by a transverse force component $F_Q$ of the longitudinal force $F_R$ which acts in the contact point of the pressure-transmission regions $24_1$, $24_2$ of the two sliding elements $18_1$, $18_2$.

FIGS. 8*a*) and 8*b*) show cross-sections along the section lines A-A and B-B shown in FIG. 3. FIG. 8*a*) shows a connecting bolt 34 held by corresponding fixing means in the sliding element 18, 20, and via which the connecting member 26 is pivotably arranged on the sliding element 18, 20. FIG. 8*b*) shows, as well as the connecting bolt 34, a guide bolt 28 via which the sliding element 18, 20 is guided in the guide groove 60 of the guide rail 50, 52. In both FIGS. 8*a*) and 8*b*), it is evident that slide surfaces 64 are arranged on both the middle guide stop 58 and on the inner and outer guide stops 54, 56. These slide surfaces 64 are preferably made of plastic and thus allow a particularly low-friction sliding of the sliding elements 18, 20 in the guide rails 50, 52 on movement of the closing device 10 between the closed position and the open position.

LIST OF REFERENCE SIGNS

2 Surface ship
4 Outer shell opening
40 Closing device
12 Shutter lamella
14 End region
16 End region
18 Sliding element
20 Sliding element
22 End face
24 Pressure-transmission region
26 Connecting member
28 Guide bolt
30 Drive device
32 Roller chain
34 Connecting bolt
40 Contact pressure device
42 Stowage area
44 Drive means
46 Deflector
48 Deflector
50 Guide rail
52 Guide rail
54 Guide stop
56 Guide stop
58 Guide stop
60 Guide groove
62 Carrier element
64 Slide surface
V Movement direction
$F_R$ Longitudinal force
$F_Q$ Transverse force

What is claimed is:

1. A closing device for closing an outer shell opening of a surface ship, comprising:

several substantially vertically mounted shutter lamellas, a drive device by means of which the shutter lamellas can be actuated between a closed position and an open position, and sliding elements configured to hold the shutter lamellas in an upper and a lower end region relative to each other in an upper and a lower guide rail of the closing device, such that on movement from the closed position to the open position, the shutter lamellas fold alternately against each other to assume the open position, wherein mutually facing end sides of the sliding elements of adjacent shutter lamellas stand in an active relationship to each other via a pressure-transmission region such that a longitudinal force imposed on the shutter lamellas in the movement direction for assuming the open position generates a transverse force component on the pressure-transmission region.

2. The closing device of claim 1, wherein the shutter lamellas are provided in an even number, which are movable in equal parts to opposite sides of the outer shell opening into the open position.

3. The closing device of claim 1, wherein the pressure-transmission region of end faces of the sliding elements is formed as a rounded contour so that adjacent sliding elements are configured to roll on each other when assuming the open position.

4. The closing device of claim 1, wherein the sliding elements of adjacent shutter lamellas are connected together via respective connecting members.

5. The closing device of claim 1, wherein the drive device actuates at least one of the shutter lamellas to move between the closed position and the open position, and indirectly actuates a remainder of the shutter lamellas via the at least one shutter lamella.

6. The closing device of claim 5, wherein the drive device comprises at least one roller chain via which the at least one shutter lamella is actuated to move between the closed position and the open position.

7. The closing device of claim 1, wherein the upper and lower guide rails comprise slide surfaces made of plastic for guiding the sliding elements in a lateral direction and a vertical direction.

8. The closing device of claim 1, wherein the shutter lamellas are made from carbon-fiber reinforced plastic (CRP), glass-fiber reinforced plastic (GRP), steel, or aluminum material.

9. The closing device of claim 1, wherein the guide rails have an inner and an outer side guide stop in the movement direction of the shutter lamellas relative to the outer shell opening.

* * * * *